US006154902A

United States Patent [19]

Russillio et al.

[11] Patent Number: 6,154,902

[45] Date of Patent: Dec. 5, 2000

[54] APPARATUS AND METHOD FOR SUPPORTING A PATIENT ON A SURFACE AND STABILIZING THE PATIENT'S ARM

[75] Inventors: Laura Russillio, Lancaster; Joan Kirchofer, West Seneca; Rita Finley, Williamsville; Ann Stanchak, Kenmore; Michele LaBarre, Tonawanda; Donna Dudek, Williamsville; Kathryn Healy, Amherst, all of N.Y.; Karen Risberg, Penbroke Pines, Fla.

[73] Assignee: Critical Concepts, Inc., Williamsville, N.Y.

[21] Appl. No.: 09/426,399

[22] Filed: Oct. 25, 1999

Related U.S. Application Data

[60] Provisional application No. 60/105,683, Oct. 26, 1998.

[51] Int. Cl.[7] ..... A47B 16/00

[52] U.S. Cl. ..... 5/623; 5/646; 5/647

[58] Field of Search ..... 5/621, 623, 646, 5/647, 426; 128/845, 846, 869, 878; 297/113, 115, 116, 411.3, 411.31

[56] References Cited

U.S. PATENT DOCUMENTS

| | | | |
|---|---|---|---|
| 2,605,152 | 7/1952 | Krewson | 5/623 X |
| 2,972,505 | 2/1961 | Weickgenannt | 5/646 |
| 3,815,588 | 6/1974 | Klausner | 128/77 |
| 4,043,330 | 8/1977 | Bansal | 128/133 |
| 4,286,588 | 9/1981 | Lovegrove | 128/133 |
| 4,698,837 | 10/1987 | Van Steenburg | 5/623 X |
| 5,154,186 | 10/1992 | Laurin et al. | 128/870 |
| 5,515,869 | 5/1996 | Powell et al. | 128/870 |
| 5,522,100 | 6/1996 | Schilling et al. | 5/86.1 |
| 5,742,962 | 4/1998 | Yoshino et al. | 5/623 |

*Primary Examiner*—Anthony Knight
*Assistant Examiner*—Fredrick Conley
*Attorney, Agent, or Firm*—Hodgson Russ Andrews Woods & Goodyear LLP

[57] ABSTRACT

An apparatus and method for supporting a patient on a surface and stabilizing the patient's arm. The apparatus includes a rigid board and an arm support extendably attached to the rigid board. The apparatus further includes a rigid board support attached to the rigid board for supporting the rigid board from the surface a sufficient distance to allow the arm support to be extended from a first retracted position to a second extended position.

23 Claims, 5 Drawing Sheets

APPARATUS AND METHOD FOR SUPPORTING A PATIENT ON A SURFACE AND STABILIZING THE PATIENT'S ARM

CROSS-REFERENCE TO RELATED APPLICATION

The present application claims the benefit of a provisional patent application, Application No. 60/105,683, filed Oct. 26, 1998.

BACKGROUND OF THE INVENTION

1. Field of the Invention

The present invention relates generally to devices and methods for assisting in providing medical care to a patient. More specifically, the present invention may be used to administer cardiopulmonary resuscitation ("CPR") to a patient, and simultaneously assist medical procedures requiring a needle to be inserted into the patient.

Needle stick incidents and the diseases transmitted thereby are not a new phenomenon. Until recently many in the health care community did not fully appreciate the risks of being stuck by a needle. Health care workers face a risk of infection from up to 20 blood-borne diseases, including viral hepatitis and HIV. Needle sticks account for approximately 80% of the hospital exposure to HIV. The danger to health care workers is a critical issue in hospitals world wide.

Blood drawing and vascular access procedures are most often cited by nurses as the activity during which injury occurs. Needle stick injuries in the emergency department occur frequently during the management of critically ill patients when a large number of personnel simultaneously attend to a single patient.

Health care workers are particularly susceptible to being stuck by a needle during the administration of CPR because the patient's arms are not stationary, making use of a needle to draw blood or introduce an IV difficult. The prior art devices fail to provide a stable surface for administering CPR that accommodates the need to use needles on a patient's arms. The present invention offers a means for stabilizing a patient's arm during CPR and thereby provides easier access to the antecubital fossa, the preferred site for vascular access procedures.

2. Discussion of Related Art

In the prior art, there are devices for restraining a patient. One such device is a spinal restraint comprising a rigid board, a plurality of restraining straps, a head support, a foot support, and carrying handles. The restraining straps extend laterally across the board from side portions thereof, the straps being longitudinally removable and laterally retractable. The head support is adapted for immobilizing the head of a patient and comprises a center support for supporting the back of the head of a patient and two side supports, one on each side of the central support, each one for supporting the side of the head of a patient and being movable between a support configuration and a loading and storing configuration in which the side support lies substantially flush with the center support. The foot support is adapted for supporting the feet of a patient and in a support configuration extends from the board, the support being movable to a storage configuration in which the support lies substantially flush with the board. The foot support is mounted on a carriage adapted for engaging a track extending longitudinally of the board, the carriage including a locking mechanism for locking the carriage, the foot support, at selected locations on the board. The handles are adapted for use in carrying the board and are located at the ends of the board, and are movable between a carrying configuration in which the handles extend beyond the ends of the board.

Such prior art devices have disadvantages. For example, they do not provide a support for an arm of the patient that allows easy access to the antecubital fossa. Furthermore, such prior art devices are not well suited for administering CPR because the straps would interfere, and such devices are not easily maneuverable by one person.

SUMMARY OF THE INVENTION

An object of the present invention is to provide a rigid surface for supporting a patient.

Another object of the present invention is to provide an apparatus and method that allows vascular access procedures to be more easily undertaken.

A further object of the present invention is to provide an apparatus that can be customized for use as a compression board and that can be made a standard size to fit in existing cardiac arrest carts.

The foregoing objectives are realized by the present invention, which includes an apparatus for supporting a patient on a surface. The apparatus has a rigid board and an arm support extendably attached to the rigid board. The apparatus also has a rigid board support attached to the rigid board for supporting the rigid board from the surface a sufficient distance to allow the arm support to be extended from a first retracted position to a second extended position. When the arm support is in the first retracted position, a substantial portion of the arm support is between the rigid board and the surface. When the arm support is in the second extended position, the substantial portion of the arm support is not between the rigid board and the surface.

In an alternative embodiment of the apparatus, a base board is attached to the rigid board support such that when the arm support is in the first retracted position, the arm support is between the rigid board and the base board. In this alternative embodiment, the base board is designed to rest on the surface described above.

The present invention also includes a method for supporting a patient on a surface and stabilizing the patient's arm. The method begins by providing an apparatus similar to that described above. Next, the apparatus is placed on a surface so that the rigid board is distanced from the surface by the rigid board support. Then, a patient is placed on the rigid board and the arm support is extended from the first retracted position to the second extended position. Subsequently, an arm of the patient is placed on the arm support.

Other objects and advantages of the present invention will become apparent to those skilled in the art from the following detailed description read in conjunction with the attached drawings and claims appended hereto.

BRIEF DESCRIPTION OF THE DRAWINGS

For a fuller understanding of the nature and objects of the invention, reference should be made to the following detailed description taken in conjunction with the accompanying drawings, in which.

BEST MODE FOR CARRYING OUT THE INVENTION

Figure 1:
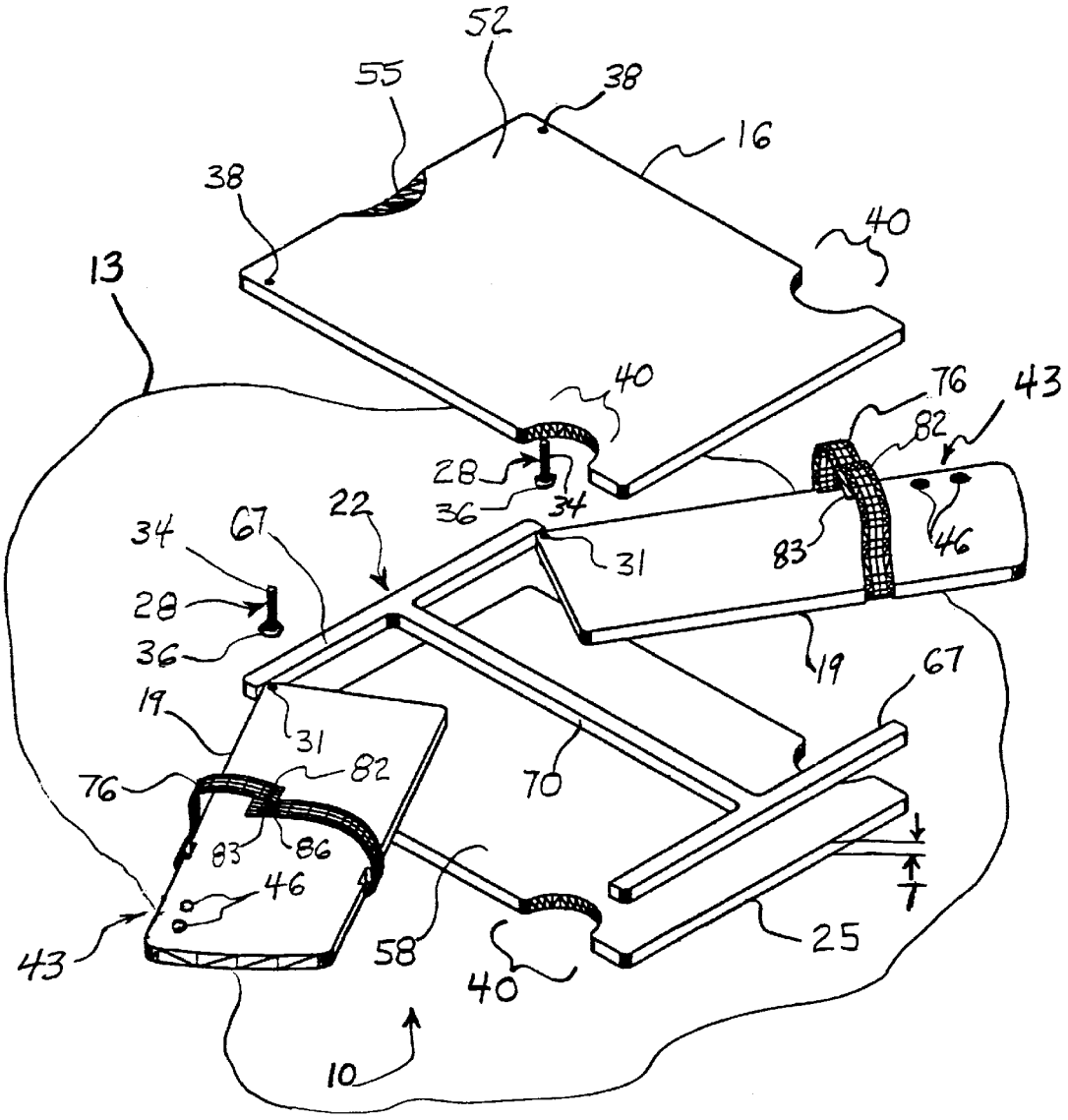
FIG. 1 is an exploded perspective view of an apparatus according to the present invention.
Figure 2:
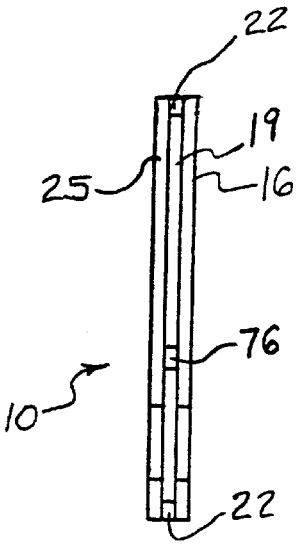
FIG. 2 is a side view of the apparatus depicted in FIG. 1 with the arm supports in the first retracted position.
Figure 3:
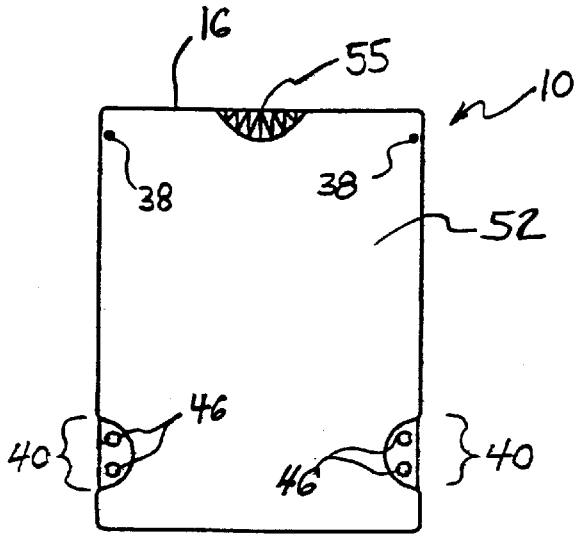
FIG. 3 is a plan view of the apparatus depicted in FIG. 2, with the arm supports in the retracted position.

FIGS. 1–4 show an apparatus according to the present invention in the form of device 10. The device 10 is designed to support a patient on a surface 13, such as a table, bed or stretcher. The device 10 has a rigid board 16 and at least one arm support 19 extendably attached to the rigid board 16. The device 10 also has a rigid board support 22 attached to the rigid board 16 for supporting the rigid board 16 from the surface 13. The device 10 may, but need not, include a base board 25 attached the rigid board support 22. The preferred means for attaching the rigid board support 22 to the rigid board 16 and the base board 25, if provided, is by molding the rigid board 16, rigid board support 22 and base board 25, if provided, into an integral unit. However, mechanical fasteners and/or an adhesive may also be used.

Figure 4:
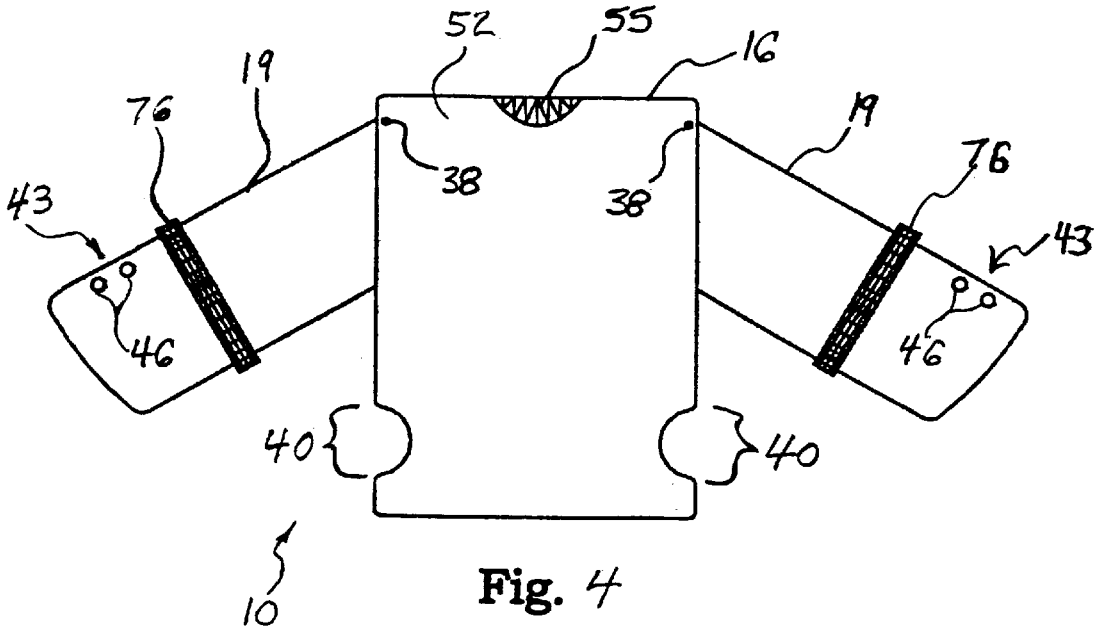
FIG. 4 is a plan view of the apparatus depicted in FIG. 2, with the arm supports in the extended position.

The rigid board support 22 supports the rigid board 16 a sufficient distance above the surface 13, or alternatively, the base board 25 if provided, to allow the arm support 19 to be extended from a first retracted position (shown in FIG. 3) to a second extended position (shown in FIG. 4). When the arm support 19 is in the first retracted position, the arm support 19 is between the rigid board 16 and the surface 13, or base board 25, as the case may be. When the arm support 19 is in the second extended position, the arm support 19 is not between the rigid board 16 and the surface 13, or base board 25, as the case may be.

A preferred means for providing extendable arm supports 19 is to hingedly attach the arm supports 19 to at least the rigid board 16 via a pivot pin 28. The pivot pin 28 extends into the rigid board 16 and through a bore 31 in the arm support 19. The pivot pin 28 may also extend into the base board 25, if the base board 25 is provided. The pivot pin 28 is prevented from leaving the bore 31 by providing a pivot pin 28 having a threaded shaft 34 and rounded head 37. The threaded shaft 34 is inserted through the arm support 19 and threaded into a mating threaded bore 38 in the rigid board 16.

The rigid board 16 and base board 25, if provided, may have a narrowed width section 40. The narrowed width section 40 permits access to the arm support 19 when the arm support 19 is in the first retracted position.

The device 10 may be provided with a handle section 43 on the arm support 19 for permitting a health care worker to grip the arm support 19 and move the arm support 19 between the first and second positions. The handle section 43 is preferably located on the arm support 19 such that the handle section 43 is exposed by the narrowed width section 40 of the rigid board 16 and the base board 25, if provided, when the arm support 19 is in the first position. The handle section 43 may have one or more holes 46 through the arm support 19. When the handle section 43 has one or more holes 46, the arm support 19 is moved from the first position to the second position by a health care worker inserting one or more fingers into the one or more holes 46 and pulling the arm support 19 to the second position. It should be noted that the holes 46 may also serve as a place to conveniently store a tourniquet.

Figure 5:
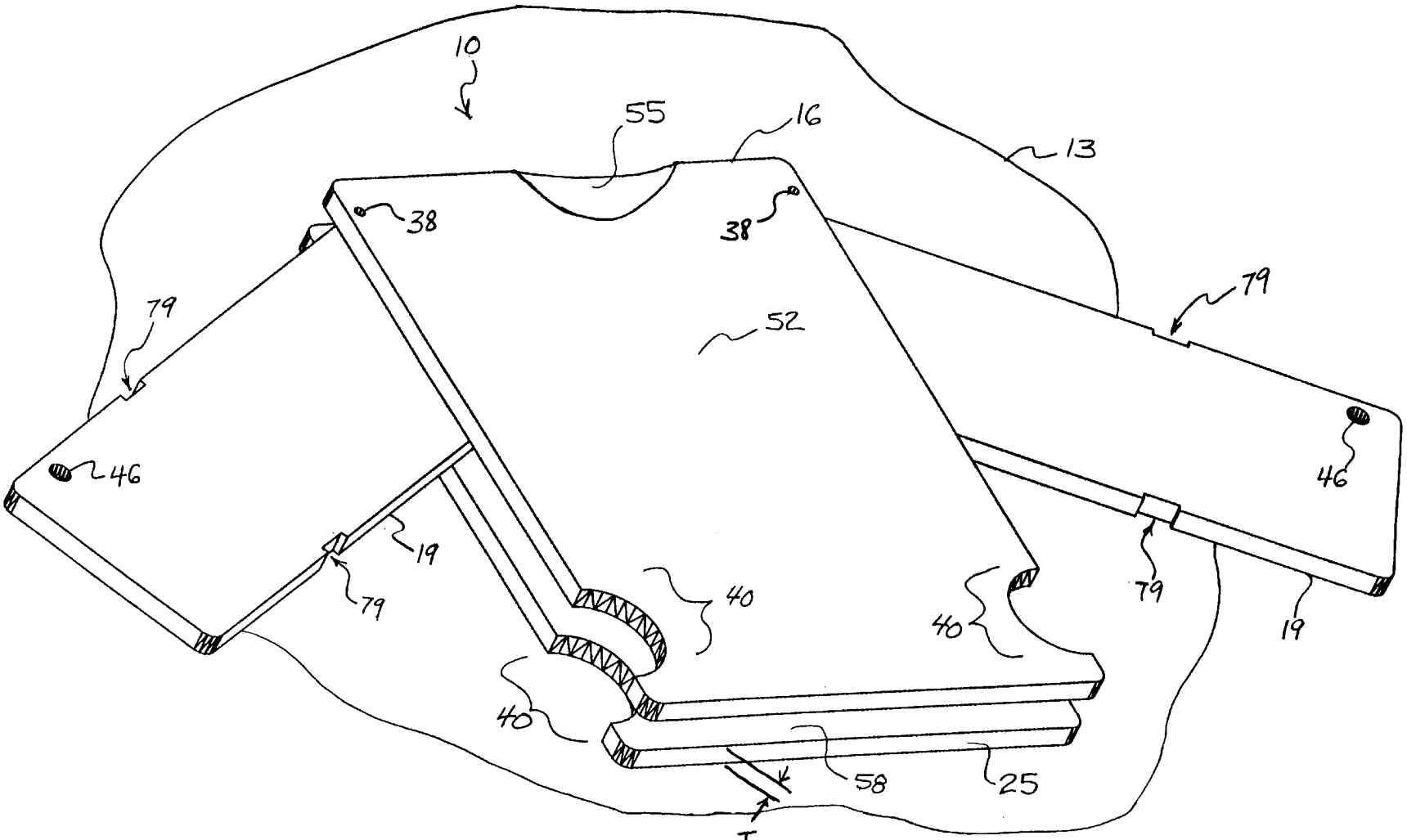
FIG. 5 is a perspective view of an embodiment of an apparatus according to the present invention, with the arm supports in the extended position and the arm straps removed to better illustrate a portion of the invention.
Figure 6:
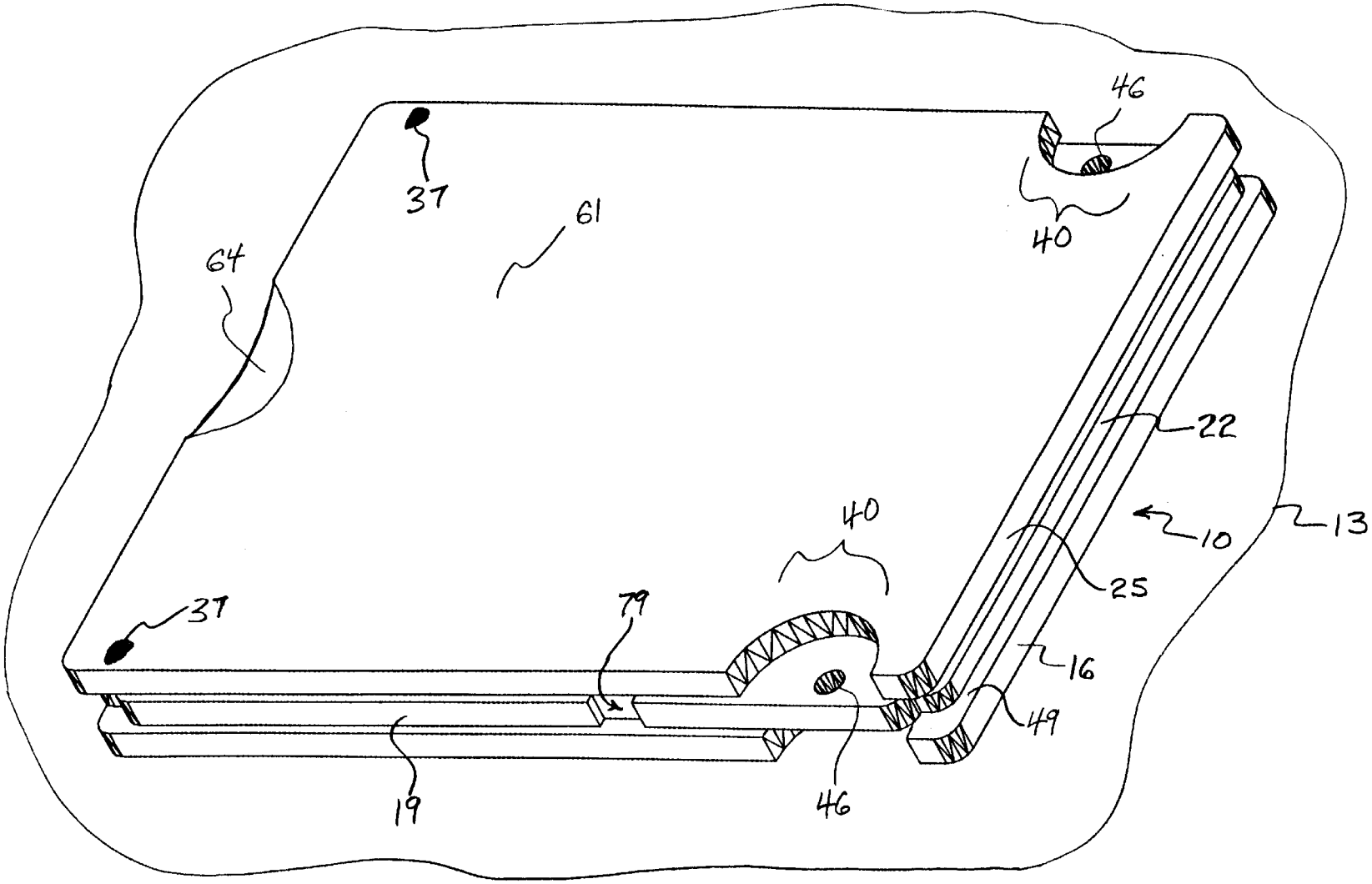
FIG. 6 is a perspective view of the apparatus depicted in FIG. 5, with the arm supports in the retracted position.

The rigid board 16 has a first side 49 to which the rigid board support 22 is attached, and a second side 52 for supporting a patient thereon. The second side 52 of the rigid board 16 may have a concave depression 55 for cradling the patient's head. Similarly, as shown in FIGS. 5 and 6, the base board 25 has a first side 58 to which the rigid board support 22 is attached, and a second side 61 that may have a concave depression 64 for cradling the patient's head and thereby making the device 10 reversible.

Those skilled in the art will now recognize that the base board 25 must be thick enough to position the arm supports 19 above sheets, blankets and a mattress that may support the device 10. For example, when the base board 25 is placed on a mattress covered with sheets and blankets, and then a patient is placed on the rigid board 25, the mattress, sheets and blankets will be compressed, and the base board 25 will sink into the mattress, sheets and blankets. In order for the arm supports 19 to be freely extended, the thickness T of the base board 25 must be at least equal to the distance the base board 25 sinks into the mattress, sheets and blankets. It is believed that a thickness T of two inches will be sufficient for most situations encountered in an emergency room of a hospital. To provide a reversible device 10, the rigid board 16 must also be thick enough to raise the arm supports 19 above the compressed mattress, sheets and blankets. Alternatively, if the weight of the device 10 must be kept low and reversibility is not needed, the rigid board 16 may be thinner than the base board 25.

The rigid board support 22 preferably includes a pair of members 67 fixedly attached to the rigid board 16. As shown in FIG. 1, the pair of members 67 are preferably substantially parallel to each other. A third member 70 disposed between the pair of members 67 may be included. The third member 70 may be connected to the pair of members 67 to form an I-beam, as shown in FIG. 1. Alternative shapes for the rigid board support 22 are also possible and the present invention is not limited to any particular placement of the pieces that comprise the rigid board support 22.

The device 10 preferably includes an arm strap 76 corresponding to each arm support 19. The arm strap 76 may be a single piece, or alternatively, may be two pieces. As best seen in FIGS. 5 and 6, in an embodiment of the present invention each arm support 19 has a notch 79 in which the arm strap 76 resides and is thereby prevented from moving along the arm support 19. As shown in FIG. 1, the arm strap 76 includes two end portions 82, 83 that are selectively attachable, one to the other. The two end portions 82, 83 may be selectively attachable by using a hook and loop fastener 86 commonly referred to as velcro™, a snap, or may be tied together.

The arm strap 76 may be sized to prevent the arm strap 76 from leaving the arm support 19. As shown in FIGS. 1 and 4, when the end portions 82, 83 are attached to each other and the arm strap 76 thereby encircles the arm support 19, the arm strap 76 is prevented by friction from leaving the arm support 19. Alternatively, the arm strap 76 may be more securely fixed to the arm support 19, for example by riveting the arm strap 76 to the arm support 19.

In use, the patient's arm is placed on the arm support 19, and then the arm strap 76 is placed around the patient's arm, and finally, the two end portions 82, 83 are attached to each other, thereby restraining the patient's arm against the arm support 19 and the arm strap 76.

The rigid board 16, arm support 19, rigid board support 22 and base board 25 are preferably made from a lightweight and durable plastic material such as polyurethane, styrene injectable molding or polyvinyl chloride so that one adult person can easily lift and properly place the device 10 under a patient. The pivot pins 28 are preferably made from stainless steel, and the arm straps are preferably made from nylon.

Finally, the device 10 may be provided in a standard size in order to fit in existing cardiac arrest carts. Such a device 10 will require only a change of mounting brackets on the cart.

Figure 7:
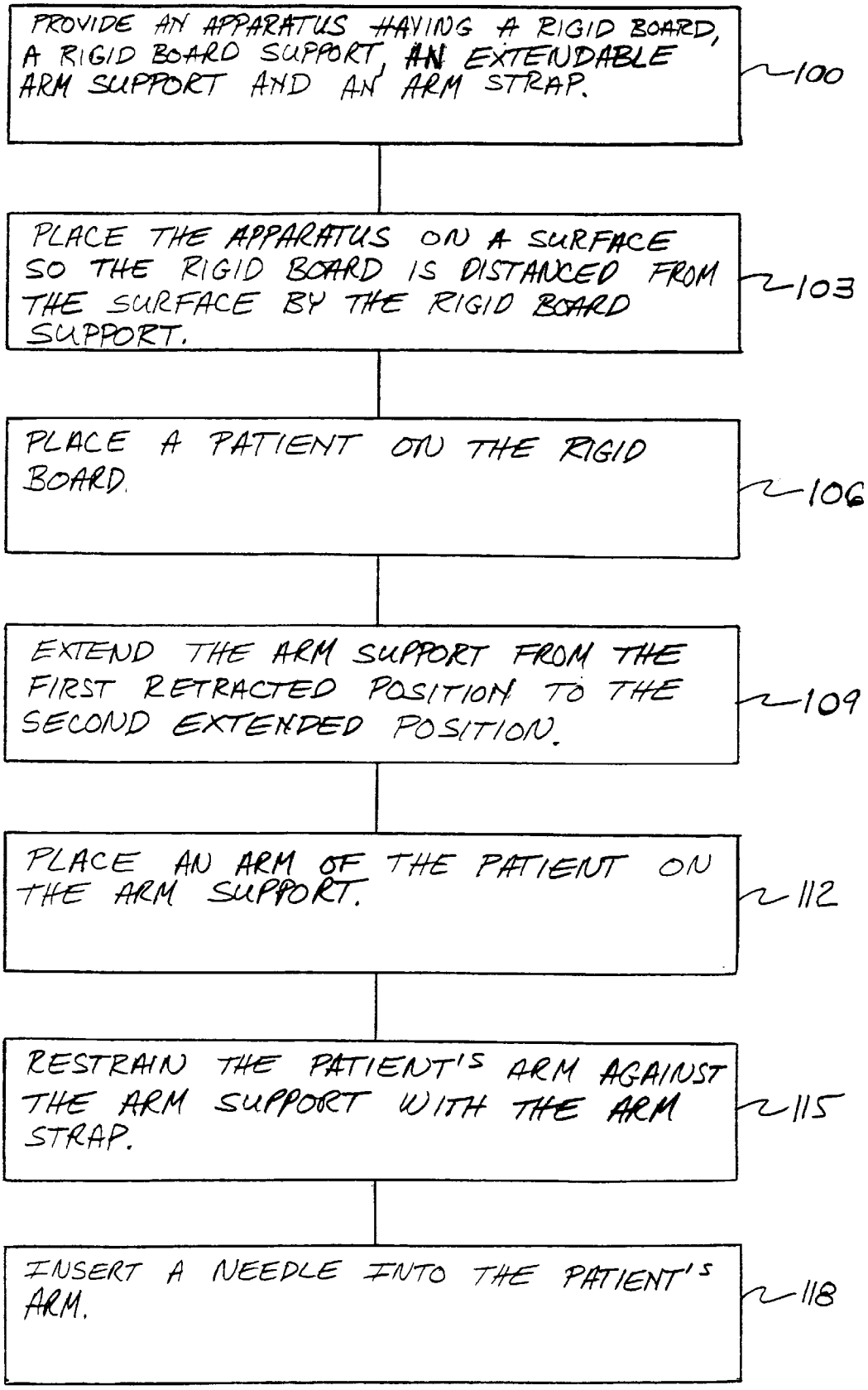
FIG. 7 shows steps of a method according to the present invention.

FIG. 7 shows steps of a method according to the present invention. The method begins by providing (step 100) an apparatus, for example the device 10 described above. Then the apparatus is placed (step 103) on a surface so that the rigid board is distanced from the surface by the rigid board support. Next, a patient is placed (step 106) on the rigid board, and then the arm support is extended (step 109) from the first position to the second position. Subsequently, an arm of the patient is placed (step 112) on the arm support. The method according to the present invention may also include the step of restraining (step 115) the patient's arm against the arm support with the arm strap, and may also include the step of inserting (step 118) a needle into the patient's arm.

It will now be apparent that the present invention provides an apparatus that can be placed under the patient prior to or during administration of CPR. The apparatus and method of the present invention permits vascular access procedures to be more easily undertaken while CPR is occurring because the present invention provides a means for restraining the patient's arms. Therefore, vascular access devices such as intravenous catheters are placed more easily, and blood samples may be drawn more easily. The movable arm supports 19 of the present invention provide a secure, highly visible work area for health care workers. As a result, use of the present invention will decrease the risk of being stuck by a needle.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. An apparatus for supporting a patient on a surface, comprising:

a rigid board;

an arm support extendably attached to the rigid board;

a rigid board support attached to the rigid board for supporting the rigid board from a surface a sufficient distance to allow the arm support to be extended from a first position to a second position, wherein when the arm support is in the first position a substantial portion of the arm support is between the rigid board and the surface, and when the arm support is in the second position the substantial portion of the arm support is not between the rigid board and the surface.

2. The apparatus of claim 1 wherein the rigid board has a narrowed width section for permitting access to the arm support when the arm support is in the first position.

3. The apparatus of claim 2 wherein the arm support has a handle section permitting gripping the arm support, the handle section being located on the arm support such that the handle section is exposed by the narrowed width section when the arm support is in the first position.

4. The apparatus of claim 3 wherein the handle section has a hole through the arm support.

5. The apparatus of claim 1 wherein the arm support has a handle section for permitting gripping of the arm support.

6. The apparatus of claim 5 wherein the handle section has a hole through the arm support.

7. The apparatus of claim 1 wherein the rigid board has a first side to which the rigid board support is attached, and a second side having a concave depression.

8. The apparatus of claim 1 wherein the rigid board support includes a pair of members fixedly attached to the rigid board such that the pair of members are substantially parallel to each other.

9. The apparatus of claim 8 wherein the rigid board support further includes a third member disposed between the pair of members.

10. The apparatus of claim 9 wherein the third member is connected to at least one of the pair of members.

11. The apparatus of claim 1 further including an arm strap corresponding to the arm support.

12. The apparatus of claim 1 further including an arm strap, wherein the arm strap has a first end and a second end, the first end being selectively attachable to the second end.

13. A apparatus for supporting a patient on a surface, comprising:

a rigid board;

an arm support extendably attached to the rigid board;

a rigid board support attached to the rigid board;

a base board attached to the rigid board support such that the arm support is selectively movable from a first position to a second position, wherein when the arm support is in the first position a substantial portion of the arm support is between the rigid board and the base board, and when the arm support is in the second position the substantial portion of the arm support is not between the rigid board and the base board.

14. The apparatus of claim 13 wherein the rigid board has a narrowed width section for permitting access to the arm support when the arm support is in the first position.

15. The apparatus of claim 14 wherein the arm support has a handle section permitting gripping the arm support, the handle section being located on the arm support such that the handle section is exposed by the narrowed width section when the arm support is in the first position.

16. The apparatus of claim 13 wherein the rigid board has a first side to which the rigid board support is attached, and a second side having a concave depression.

17. The apparatus of claim 16 wherein the base board has a first side to which the rigid board support is attached, and a second side having a concave depression.

18. The apparatus of claim 13 wherein the rigid board support includes a pair of members fixedly attached to the rigid board such that the pair of members are substantially parallel to each other.

19. The apparatus of claim 18 wherein the rigid board support further includes a third member disposed between the pair of members.

20. The apparatus of claim 13 further including an arm strap corresponding to the arm support.

21. The apparatus of claim 13 further including an arm strap, wherein the arm strap has a first end and a second end, the first end being selectively attachable to the second end.

22. A method of supporting a patient and stabilizing the patient's arm, comprising:

providing a compression board having a rigid board, an arm support extendably attached to a side of the rigid board and a rigid board support attached to the side of the rigid board;

placing the compression board on a surface so that the rigid board is distanced from the surface by the rigid board support;

placing a patient on the rigid board;

extending the arm support from a first position to a second position, wherein when the arm support is in the first position a substantial portion of the arm support is between the rigid board and the surface, and when the arm support is in the second position the substantial portion of the arm support is not between the rigid board and the surface;

placing an arm of the patient on the arm support to support the patient and stabilize the patient's arm.

23. The method of claim 22 wherein the compression board further includes an arm strap and the method further includes the step of restraining the patient's arm against the arm support with the arm strap.

* * * * *